US010955214B1

(12) United States Patent
Achkar

(10) Patent No.: US 10,955,214 B1
(45) Date of Patent: Mar. 23, 2021

(54) MASS TRANSFER MODULE ATTACHABLE TO A STRIP STOP OF AN ARCHERY BOW

(71) Applicant: Nibal Achkar, Biggar (CA)

(72) Inventor: Nibal Achkar, Biggar (CA)

( * ) Notice: Subject to any disclaimer, the term of this patent is extended or adjusted under 35 U.S.C. 154(b) by 0 days.

(21) Appl. No.: 16/718,326

(22) Filed: Dec. 18, 2019

Related U.S. Application Data

(60) Provisional application No. 62/793,608, filed on Jan. 17, 2019.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/86, 88, 89
See application file for complete search history.

(56) References Cited

U.S. PATENT DOCUMENTS 3,342,172 A * 9/1967 Sanders ..... F41B 5/1426 124/23.1
4,054,121 A * 10/1977 Hoyt, Jr. ..... F41B 5/1426 124/89
4,461,267 A * 7/1984 Simonds ..... F41B 5/10 124/25.6
5,320,085 A * 6/1994 Hanneman ..... F41B 5/1426 124/86
5,720,269 A * 2/1998 Saunders ..... F41B 5/1407 124/25.6
5,992,403 A * 11/1999 Slates ..... F41B 5/1426 124/89
6,178,958 B1 * 1/2001 Gallops, Jr. ..... F41B 5/10 124/25.6
6,382,201 B1 * 5/2002 McPherson ..... F41B 5/0005 124/23.1
6,526,957 B1 * 3/2003 Leven ..... F41B 5/1426 124/89
6,532,945 B1 * 3/2003 Chattin ..... F41B 5/10 124/25.6
6,550,467 B2 * 4/2003 Gallops, Jr. ..... F41B 5/1407 124/25.6
6,715,479 B1 * 4/2004 Bunk ..... F41B 5/10 124/25.6
6,862,813 B1 * 3/2005 Chen ..... F41G 1/467 33/263
7,753,044 B2 * 7/2010 Goade ..... F41B 5/1426 124/89
7,793,646 B2 * 9/2010 Cooper ..... F41B 5/1407 124/89

(Continued)

*Primary Examiner* — Alexander R Niconovich
(74) *Attorney, Agent, or Firm* — Donald J. Ersler

(57) ABSTRACT

A mass transfer module attachable to a string stop of an archery bow preferably includes a fastener, a clamp, a hole and at least one a weight component and a vibration dampening device. The clamp is located on one end of the mass transfer module and the threaded hole is located on an opposing end. The clamp is secured to a string stop rod by tightening the fastener. In an alternative embodiment, an extension rod may be used to extend the weight component and/or vibration dampening device away from a mass body of the mass transfer module. In an alternative embodiment, the hole may be replaced with a stop clamp. In another embodiment the mass transfer module may be pivotally secured to the string stop rod in two axes.

16 Claims, 4 Drawing Sheets

(56) References Cited

U.S. PATENT DOCUMENTS 7,954,481 B2 * 6/2011 Barnard ..... F41B 5/1426 124/88
8,276,576 B1 * 10/2012 Kuhn ..... F41B 5/1426 124/89
8,522,767 B1 * 9/2013 Kuhn ..... F41B 5/1426 124/89
8,646,440 B1 * 2/2014 Albanese ..... F41B 5/1426 124/88
8,701,645 B2 * 4/2014 Stokes ..... F41B 5/1426 124/89
8,839,776 B2 * 9/2014 Kingsbury ..... F41B 5/1426 124/89
8,869,785 B2 * 10/2014 Bidigare ..... F41B 5/1426 124/89
9,038,617 B1 * 5/2015 Khoshnood ..... F41B 5/1426 124/89
9,140,515 B2 * 9/2015 Yi ..... F41B 5/10
9,377,270 B2 * 6/2016 Stokes ..... F41B 5/1426
9,429,383 B2 * 8/2016 Martens ..... F41B 5/1426
9,915,494 B2 * 3/2018 Potts ..... F41B 5/148
10,240,886 B1 * 3/2019 Huang ..... F41B 5/1426
10,619,966 B2 * 4/2020 Ozanne ..... F41B 5/0031
10,619,967 B2 * 4/2020 Kelly ..... F16F 7/104
2003/0226556 A1 * 12/2003 Leven ..... F16F 7/108 124/89
2008/0264400 A1 * 10/2008 Wright ..... F41B 5/1426 124/89
2009/0133683 A1 * 5/2009 Wright ..... F41B 5/1407 124/89
2010/0095943 A1 * 4/2010 Cooper ..... F41B 5/1426 124/89
2010/0224178 A1 * 9/2010 McPherson ..... F41B 5/1426 124/25.6
2012/0125310 A1 * 5/2012 Khoshnood ..... F41B 5/1426 124/89
2013/0047972 A1 * 2/2013 Walk ..... F41B 5/1426 124/25.6
2013/0055998 A1 * 3/2013 LoRocco ..... F41B 5/1426 124/89
2013/0174825 A1 * 7/2013 Bednar ..... F41B 5/1426 124/88
2014/0060514 A1 * 3/2014 Bidigare ..... F41B 5/1426 124/88
2014/0116408 A1 * 5/2014 McPherson ..... F41B 5/1426 124/25.6

* cited by examiner

MASS TRANSFER MODULE ATTACHABLE TO A STRIP STOP OF AN ARCHERY BOW

CROSS-REFERENCES TO RELATED APPLICATIONS

This is a nonprovisional patent application claiming the benefit of provisional patent application No. 62/793,608 filed on Jan. 17, 2019.

BACKGROUND OF THE INVENTION

Field of the Invention

The present invention relates generally to archery and more specifically to a mass transfer module attachable to a string stop of an archery bow, which includes an adjustable device that can alleviate imbalance and/or vibration caused by bow design or added accessories.

Discussion of the Prior Art

It appears that previous prior art does not disclose a mass transfer module attachable to a string stop of an archery bow string stop mounted device, which can be adjusted and configured in any plane and to any angle.

Accordingly, there is a clearly felt need for a mass transfer module attachable to a string stop of an archery bow, which includes an adjustable device that can alleviate imbalance and/or vibration caused by bow design or added accessories, and which can be adjusted and configured in any plane and to any angle.

SUMMARY OF THE INVENTION

The present invention provides a mass transfer module attachable to a string stop of an archery bow, which includes an adjustable device that can alleviate bow imbalance and/or vibration caused by bow design or added accessories. The mass transfer module attachable to a string stop of an archery bow (mass transfer module). The mass transfer module is attached to a string stop rod. The mass transfer module includes a threaded hole to threadably receive a weighted counter balance and/or a vibration dampening unit.

As the variations in bow designs are considerable, so are the preferred configurations of this invention, which will be individually described in the Brief Description of the Drawings as well as the Detailed Description of the Preferred Embodiments.

Accordingly, it is an object of the present invention to provide a mass transfer module, which includes an adjustable device that can alleviate bow imbalance and/or vibration caused by bow design or added accessories.

Finally, it is another object of the present invention to provide a mass transfer module, which can be adjusted and configured in any plane and to any angle.

These and additional objects, advantages, features and benefits of the present invention will become apparent from the following specification.

DETAILED DESCRIPTION OF THE PREFERRED EMBODIMENTS

Figure 1:
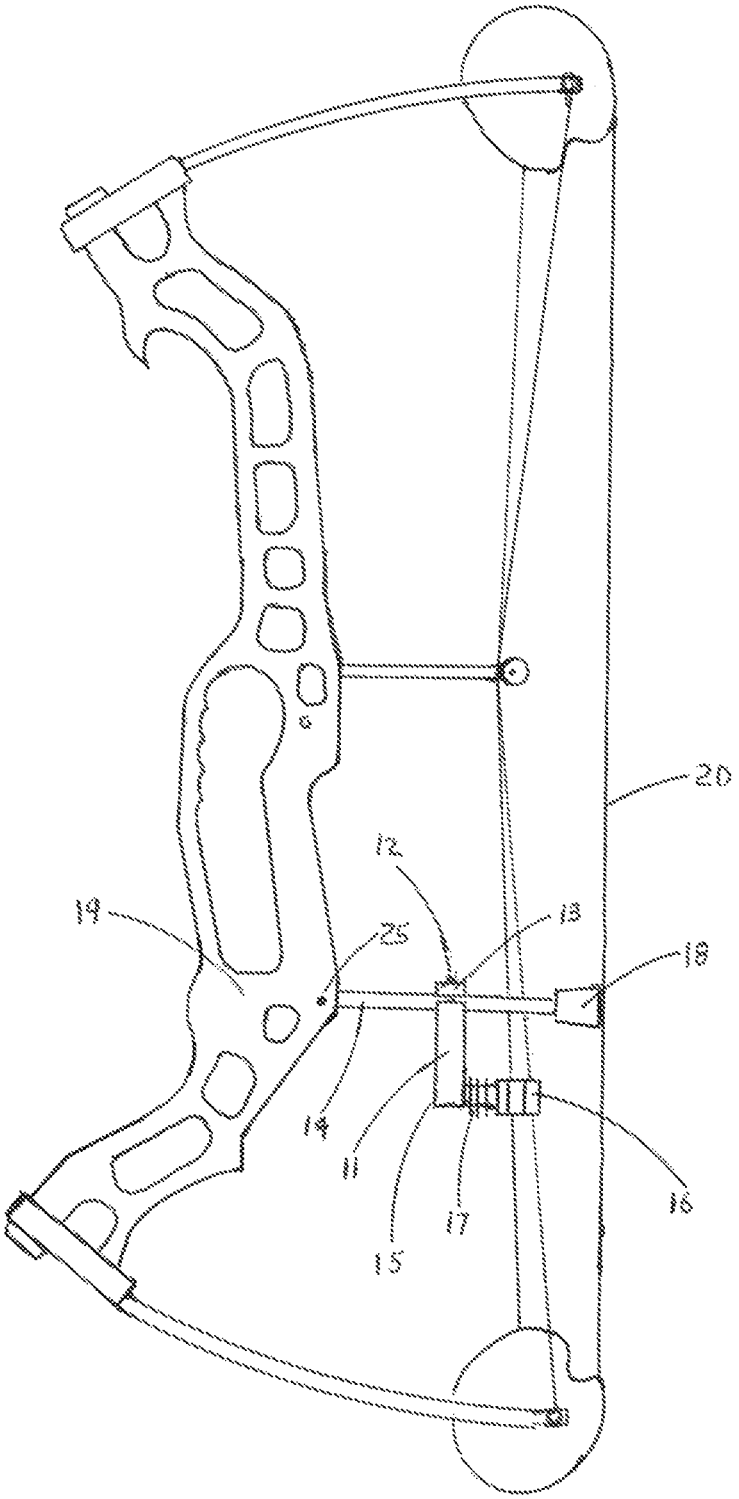
FIG. 1 is a side view of a mass transfer module attached to a string stop of a compound archery bow in accordance with the present invention.
Figure 2:
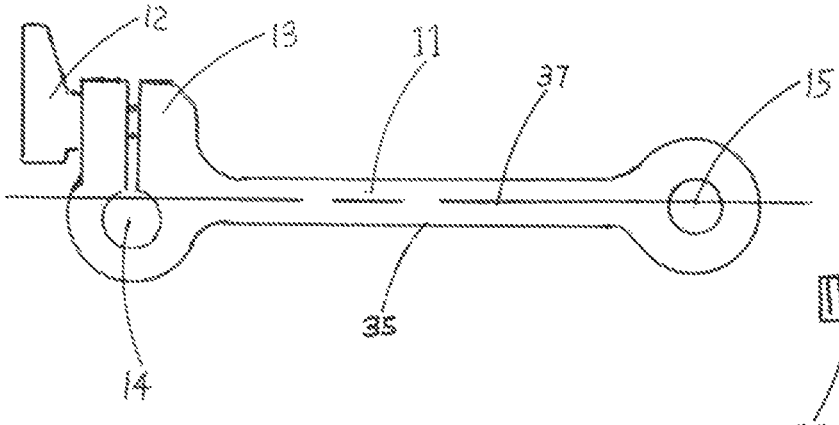
FIG. 2 is an end view of a mass transfer module having a split clamp for mounting on a string stop and with a weight component and a vibration dampening device removed in accordance with the present invention.
Figure 2A:
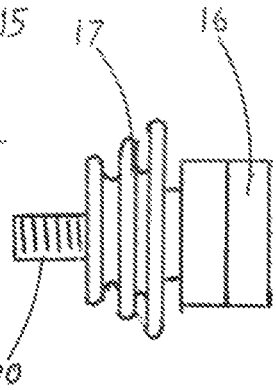
FIG. 2*a* is a side view of a weight component and a vibration dampening device of a mass transfer module in accordance with the present invention.
Figure 4:
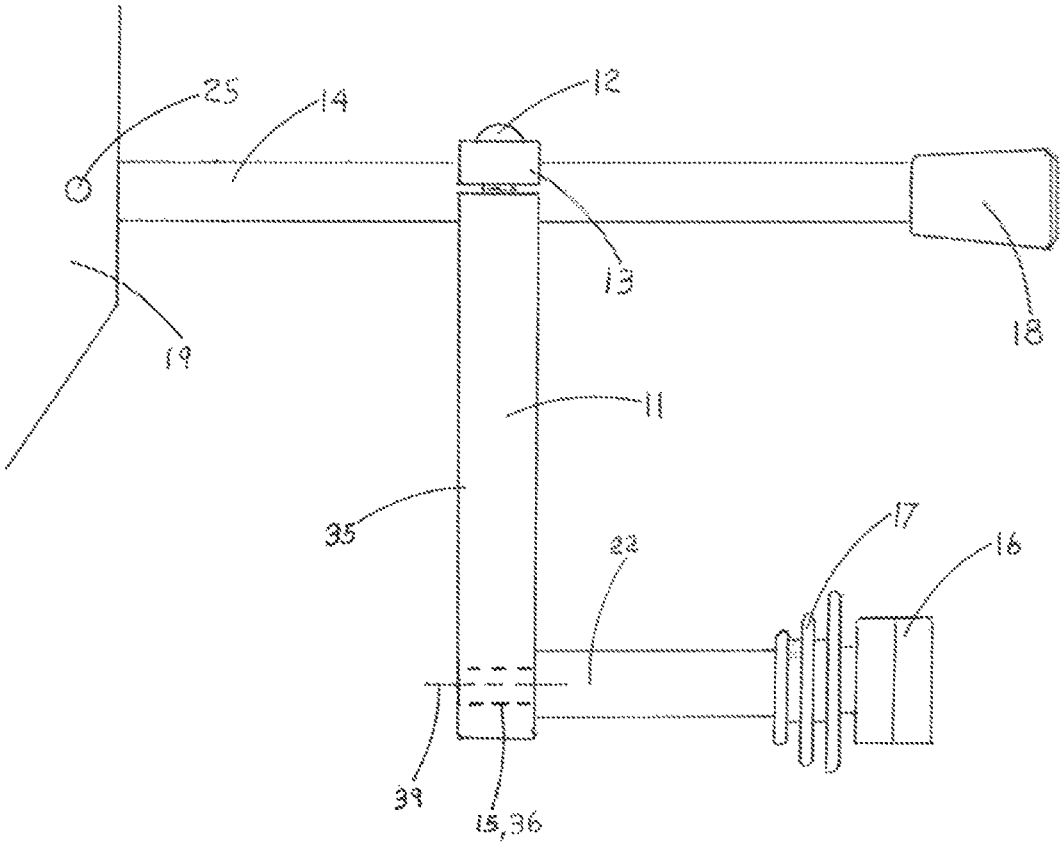
FIG. 4 is a side view of a mass transfer module with an extension rod installed between a mass body, a vibration dampening device and a weight component in accordance with the present invention.

With reference now to the drawings, and particularly to FIG. 1, there is shown a mass transfer module (11) secured to an archery bow (19). A bow string (20) contacts a string stop dampener (18), which is attached at the end of a string stop rod/shaft (14). With reference to FIGS. 2-2*a*, the mass transfer module (11) preferably includes a mass body (35), a weight component (16) and a vibration dampening device (17). With reference to FIG. 4, the mass body (35) includes a clamp (13) and a threaded hole (15). The mass body (35) includes a lengthwise axis (37). The threaded hole (15) includes a lengthwise axis (39). The clamp (13) is located on one end of the mass body (35) and the threaded hole (15) is located on an opposing end. The clamp (13) is secured to a string stop rod (14) by tightening a fastener (12). The fastener (12) may be any suitable threaded fastener, such as a wing nut, a bolt, a cap screw or any other suitable threaded fastener. However, the string stop rod (14) or the bumper (18) must be removed to insert the string stop rod (14) through the clamp (13). The vibration dampening device (17) preferably includes a weight component (16) and a threaded member (30). However, the weight component (16) and a fastener (44) may be used without the vibration dampening device (17). The threaded member (30) of the vibration dampening device (17) is threadably retained in the threaded hole (15).

Figure 3:
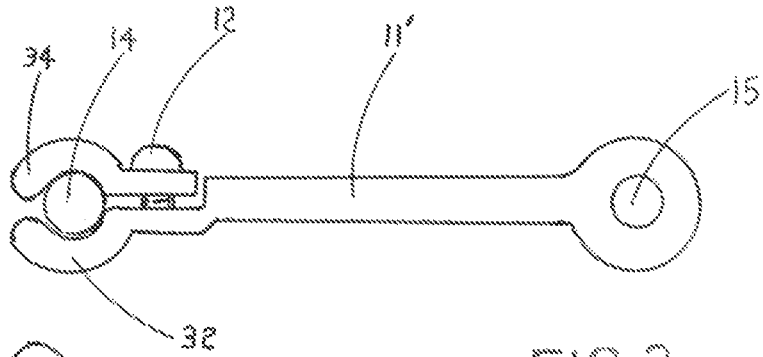
FIG. 3 is an end view of a mass transfer module having an alternative embodiment of a split clamp with a weight component and a vibration dampening device removed in accordance with the present invention.
Figure 3A:
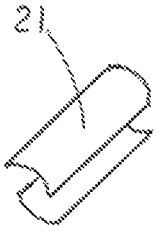
FIG. 3*a* is a perspective view of a split bushing of a mass transfer module in accordance with the present invention.

With reference to FIG. 3, a mass transfer module (11') with an alternative embodiment of a clamp (32). The clamp (32) includes a clamp member (34) and the fastener (12). The clamp (32) may be secured to the string stop rod (14) without removal of the string stop rod (14) or a rubber bumper (18) as with the mass transfer module (11). With reference to FIG. 3*a*, a split bushing (21) is inserted into the clamp (13, 32) to make-up for a string stop rod, which is much smaller than an opening in the clamp (13, 32).

With reference to FIG. 4, a threaded shaft (36) extends from one end of an extension rod (22). The threaded shaft (36) is threaded into the threaded hole (15) of the mass transfer module (11). The vibration dampener (17) and/or the weight component (16) are preferably threadably retained in an opposing end of the extension rod (22). The extension rod (22) extends a length between the mass transfer module (11), the vibration dampener (17) and/or the weight component (16). The extension rod (22) can be manufactured in different lengths. The extension rod (22) can be of any length and also may be installed on reverse side of the mass transfer module (11), if required, for balance.

Figure 5:
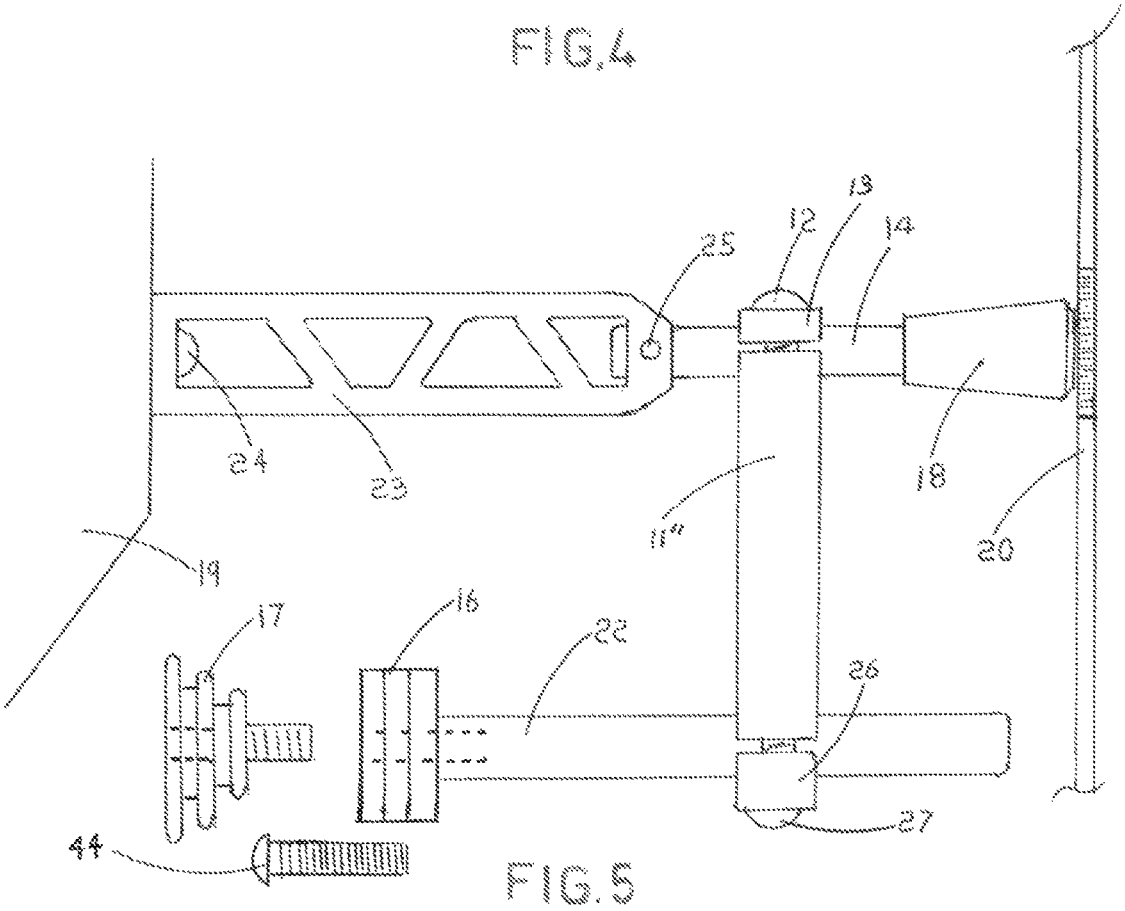
FIG. 5 is a partially exploded side view of an archery bow riser, which uses a string stop extension bracket that is installed to the riser with a fastener; a short string stop rod extends from the string stop extension bracket; a mass transfer module with an extension rod; and a weight component may be installed with a fastener and/or a vibration dampener in accordance with the present invention.

With reference to FIG. 5, a mass transfer module (11") is secured to a string stop rod (14). The string stop rod (14) is secured to one end of a string stop extension bracket (23). The other end of the string stop extension bracket (23) is attached to a bow (19) with a screw fastener (24). The string stop rod (14) is inserted into a hole in the one end of the string stop extension bracket (23). An adjustment set screw (25) is used to allow axially adjustment of the string stop rod (14) relative to the string stop extension bracket (23). The mass transfer module (11") includes the clamp (13) on one end and a stop clamp (26) on an opposing end. The stop clamp (26) includes a fastener (27). Due to the short length of the string stop rod (14), the extension rod (22) may be retained in the stop clamp (26). The extension rod (22) may be adjusted fore or aft as required. The extension rod (22) can be manufactured to various lengths depending on balancing requirements. The weight component (16) cab be installed on the extension rod (22) with a fastener (44) and/or the vibration dampener (17) can be installed on the extension rod (22) with the threaded member (30).

Figure 6:
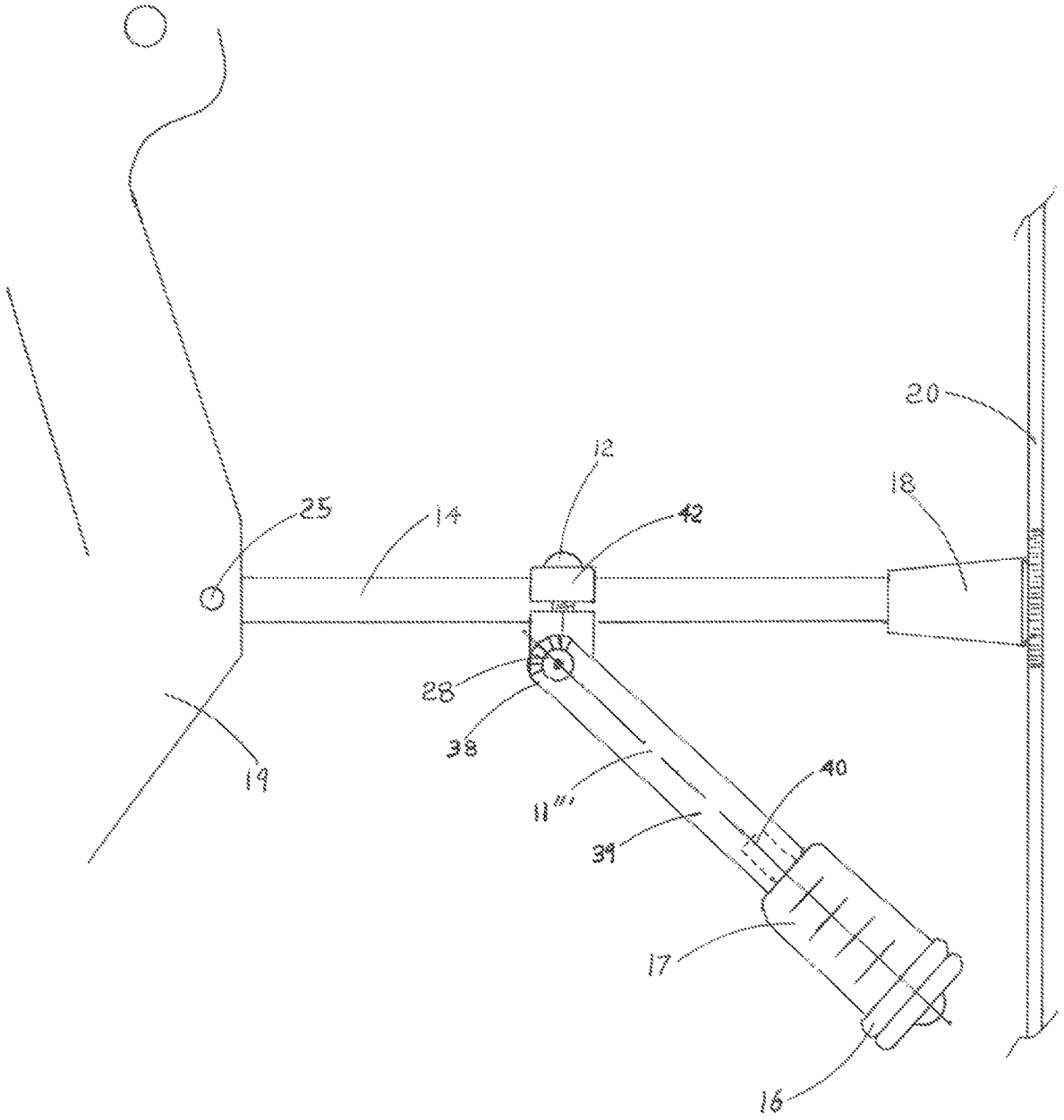
FIG. 6 is an alternative embodiment of a mass transfer module with a swivel arm for attachment to a string stop, the mass transfer module can be rotated to any angle relative to the string stop rod in accordance with the present invention.

With reference to FIG. 6, a mass transfer module (11'") includes a swivel arm (38) and a mass member (39). A threaded hole (40) is formed on one end of the mass member (39). The threaded hole (40) is to a lengthwise axis of the mass member (39). The swivel arm (38) includes a clamp member (42) and a lock screw (28). The clamp member (42) includes the fastener (12). The swivel arm (38) is secured to an opposing end of the mass member (39) with the lock screw (28). The mass transfer module (11'") is attached to the string stop rod (14) with clamp member (42). The weight component (16) may be installed with the fastener (44) and/or the threaded member (30) of the vibration dampener (17) is threaded into the threaded hole (40). The mass transfer module (11'") may be slid forward or rearward and rotated on the string stop rod (14). The mass transfer module (11'") can be swivelled into a forward or rearward position to meet balancing and vibration dampening requirements.

The mass transfer module (11-11'") may be quickly and easily adjusted on the archery bow (19) by allowing thereof to slide back and forth over a full length of the string stop rod (14) and rotating thereof around the string stop rod (14) to correct imbalance and/or vibration due to accessory installation and bow design. When an archery bow (19) is fired, the bow string (20) contacts the rubber bumper (18) of the string stop rod (14) and vibrations are transmitted down the string stop rod (14). The vibrations are absorbed by the mass transfer module (11-11'"), which is attached to the string stop rod (14).

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A mass transfer module attachable to a string stop of an archery bow, the string stop is attached directly to a riser of an archery bow, comprising:

a mass body includes a clamp and a component hole, said clamp is located on one end of said mass body, said hole is located on an opposing end; and a vibration dampening member having one end threaded into said component hole of said mass body, at least one weight component is fixed to said vibration dampening member and fixed relative to said mass body, wherein said mass transfer module is secured to a string stop rod of the string stop, said mass body is pivotable 360 degrees about the string stop rod and relative to the riser, said mass body is slidably relative to the riser and along a length of the string stop rod.

2. The mass transfer module attachable to a string stop of an archery bow of claim 1 wherein:

said clamp includes a fastener, the string stop rod is secured in said clamp by tightening said fastener.

3. The mass transfer module attachable to a string stop of an archery bow of claim 1 wherein:

said clamp includes a clamp member, said clamp member is a separate piece from said clamp.

4. The mass transfer module attachable to a string stop of an archery bow of claim 1 wherein:

an axis of said component hole is perpendicular to a lengthwise axis of mass body.

5. The mass transfer module attachable to a string stop of an archery bow of claim 1, further comprising:

a split bushing for accommodating the string stop rod with a different diameter.

6. The mass transfer module attachable to a string stop of an archery bow of claim 1 wherein:

said at least one of a weight component and a vibration dampening member includes a threaded extension, said weight component and said vibration dampening member, one end of said vibration dampening member extends from said weight component, said threaded extension extends from an opposing end of said vibration dampening member.

7. A mass transfer module attachable to a string stop of an archery bow, the string stop is attached directly to a riser of an archery bow comprising:

a mass body includes a mass member and a swivel arm, said mass member includes a rod clamp located on one end thereof, a component hole is formed in one end of said swivel arm, said swivel arm is pivotally engaged with an opposing end of said mass member, a lengthwise axis of the string stop is perpendicular to a pivot axis of said swivel arm; and a vibration dampening member having one end threaded into said component hole of said swivel arm, at least one of weight component is fixed on an opposing end of said vibration member, wherein said mass transfer module is attached to a string stop rod of the string stop, said mass body is pivotable 360 degrees about the string stop rod and relative to the riser, said mass body is slidably relative to the riser and along a length of the string stop rod.

8. The mass transfer module attachable to a string stop of an archery bow of claim 7 wherein:

said rod clamp includes a fastener, the string stop rod is secured in said rod clamp by tightening said fastener.

9. The mass transfer module attachable to a string stop of an archery bow of claim 7 wherein:

an axis of said component hole is parallel to a lengthwise axis of swivel arm.

10. The mass transfer module attachable to a string stop of an archery bow of claim 7, further comprising:

a split bushing for accommodating the string stop rod with a different diameter.

11. A mass transfer module attachable to a string stop of an archery bow, the string stop is attached to a riser of an archery bow comprising:

a mass body includes a clamp and a rod clamp, said clamp is located on one end of said mass body, said rod clamp is located on an opposing end;

an extension rod is slidably relative to said rod clamp; and at least one weight component is in contact with one end of said extension rod, a vibration member retains said at least one weight and is engaged with said one end of said extension rod, said extension rod is retained in said rod clamp, wherein a string stop rod of the string stop is retained in said clamp, wherein said mass body is pivotable 360 degrees about the string stop rod and relative to the riser, said mass body is slidably relative to the riser and along a length of the string stop rod.

12. The mass transfer module attachable to a string stop of an archery bow of claim 11 wherein:

said clamp includes a fastener, the string stop rod is secured in said clamp by tightening said fastener.

13. The mass transfer module attachable to a string stop of an archery bow of claim 11 wherein:

said rod clamp includes a rod fastener, said rod clamp is secured to said extension rod by tightening said rod fastener.

14. The mass transfer module attachable to a string stop of an archery bow of claim 11, further comprising:

a split bushing for accommodating the string stop rod with a different diameter.

15. The mass transfer module attachable to a string stop of an archery bow of claim 11, further comprising:

said vibration damping device includes a threaded rod, said vibration damping device is threaded into said one end of said extension rod.

16. The mass transfer module attachable to a string stop of an archery bow of claim 11, further comprising:

said weight component is retained on said one end of said extension rod with a weight fastener.

* * * * *